US012064815B2

(12) United States Patent
Tanabe et al.

(10) Patent No.: US 12,064,815 B2
(45) Date of Patent: Aug. 20, 2024

(54) METHOD FOR MANUFACTURING WICK

(71) Applicant: PORITE CORPORATION, Saitama (JP)

(72) Inventors: Shigeyuki Tanabe, Saitama (JP); Shinobu Aso, Saitama (JP); Kazuki Sadakata, Saitama (JP)

(73) Assignee: PORITE CORPORATION, Saitama (JP)

( * ) Notice: Subject to any disclaimer, the term of this patent is extended or adjusted under 35 U.S.C. 154(b) by 865 days.

(21) Appl. No.: 16/982,913

(22) PCT Filed: Mar. 11, 2019

(86) PCT No.: PCT/JP2019/009617
§ 371 (c)(1),
(2) Date: Sep. 21, 2020

(87) PCT Pub. No.: WO2019/181598
PCT Pub. Date: Sep. 26, 2019

(65) Prior Publication Data

US 2021/0016354 A1 Jan. 21, 2021

(30) Foreign Application Priority Data

Mar. 19, 2018 (JP) ..... 2018-051832

(51) Int. Cl.

| | |
|---|---|
| ***B22F 7/08*** | (2006.01) |
| ***B22F 3/18*** | (2006.01) |
| ***F28D 15/04*** | (2006.01) |
| ***F28F 21/08*** | (2006.01) |

(52) U.S. Cl.
CPC ..... *B22F 7/08* (2013.01); *B22F 3/18* (2013.01); *F28D 15/04* (2013.01); *F28F 21/08* (2013.01)

(58) Field of Classification Search
CPC .. F28D 15/04; F28F 21/08; B22F 7/08; B22F 3/18
See application file for complete search history.

(56) References Cited

FOREIGN PATENT DOCUMENTS

| | | | |
|---|---|---|---|
| CN | 201715908 | 1/2011 | |
| EP | 2157391 A1 * | 2/2010 | ..... F28D 15/02 |
| JP | 2000-54159 | 2/2000 | |
| JP | 2002-22380 | 1/2002 | |

(Continued)

OTHER PUBLICATIONS

P. Samal, J. Newkirk, ASM Handbook Powder Metallurgy, ASM International, vol. 7, Table 1, 2015 (Year: 2015).*

(Continued)

*Primary Examiner* — Anthony M Liang
*Assistant Examiner* — Jacob J Gusewelle
(74) *Attorney, Agent, or Firm* — Wenderoth, Lind & Ponack, L.L.P.

(57) ABSTRACT

A method for manufacturing a wick includes: supplying material powder containing metal powder onto a base; heating the material powder on the base to obtain a sintered compact; and rolling the sintered compact. In this situation, when the material powder supplied onto the base is heated to form the sintered compact, the sheet-shaped sintered compact can be formed. Further, when the sintered compact is rolled, a void ratio of the sintered compact can be controlled after forming the sintered compact, thereby controlling the capillarity of the wick.

13 Claims, 5 Drawing Sheets

(56) References Cited

FOREIGN PATENT DOCUMENTS

| | | | | | |
|---|---|---|---|---|---|
| JP | 2004-231997 | | | 8/2004 | |
| JP | 2007017038 | A | * | 1/2007 | ..... F28D 15/0283 |
| JP | 2013-2640 | | | 1/2013 | |
| JP | 2013-72135 | | | 4/2013 | |
| JP | 2013-241680 | | | 12/2013 | |
| JP | 2014-13116 | | | 1/2014 | |
| JP | 2014-70863 | | | 4/2014 | |
| JP | 2017-57467 | | | 3/2017 | |
| TW | 1261659 | B | * | 9/2006 | |
| WO | WO-2017089960 | A1 | * | 6/2017 | |

OTHER PUBLICATIONS

International Search Report issued May 14, 2019 in International (PCT) Application No. PCT/JP2019/009617.

* cited by examiner

METHOD FOR MANUFACTURING WICK

TECHNICAL FIELD

The present invention relates to a method for manufacturing a wick used in a heat conduction member (a heat radiation member) such as a heat pipe or a vapor chamber, and more particularly to a method for manufacturing a wick which facilitates forming a sheet-shaped wick.

BACKGROUND ART

Recently, in electronic devices such as a personal computer or a mobile terminal, a calorific value and heat generation density of a heating body such as an electronic element have increased with high integration of the electronic element, miniaturization of a device, and the like, and installation of a heat conduction member configured to discharge heat of the heating body is absolutely necessary.

For example, in the above-described devices, a heat conduction member such as a heat pipe or a vapor chamber which moves heat from the heating body by circulation of a working fluid is installed. In such a heat conduction member, capillarity of a wick having a capillary structure produces the circulation of the working fluid.

Here, in the wick, as a hole diameter of a capillary tube decreases, the capillarity increases, and movement of the working fluid is promoted. Thus, in conventional examples, to increase the capillarity, a technology to constitute a wick by using a sintered compact has been suggested (see Patent Documents 1 and 2).

According to this technology, after filling a container with metal powder, externally heating the container provides a wick made of a sintered compact in the container. Alternatively, a mold which approximates a final shape of the wick arranged in the container is prepared, this mold is filled with the metal powder, and then the mold is externally heated, thereby forming the wick made of the sintered compact.

CITATION LIST

Patent Literature

Patent Document 1: Japanese Unexamined Patent Application Publication No. 2014-70863

Patent Document 2: Japanese Unexamined Patent Application Publication No. 2014-13116

SUMMARY OF INVENTION

Technical Problem

However, conventional methods for manufacturing a wick have a fear that forming a sheet-shaped wick becomes difficult.

A problem of the present invention is to provide a method for manufacturing a wick which facilitates forming a sheet-shaped wick.

Solution to Problem

To solve the problem, a method for manufacturing a wick according to a first invention is characterized by including: a step of supplying a raw material containing metal powder; and a step of heating the raw material on the base to obtain a sintered compact.

In the method for manufacturing a wick according to the first invention, heating the raw material supplied onto the base results in forming the sintered compact. Consequently, the wick made of the sheet-shaped sintered compact can be formed.

Here, a frame body, a tray T, a metal belt 11*a*, and the like, which will be described later, correspond to the base.

In the method for manufacturing a wick according to the first invention, a method for manufacturing a wick according to a second invention is characterized in that the raw material contains a binder.

In the method for manufacturing a wick according to the first or second invention, a method for manufacturing a wick according to a third invention is characterized in that the raw material on the base is heated together with the base.

In the method for manufacturing a wick according to any one of the first to third inventions, a method for manufacturing a wick according to a fourth invention is characterized in that the base is made of a metal.

Advantageous Effects of Invention

According to the method for manufacturing a wick of the present invention, forming the sheet-shaped wick can be facilitated.

DESCRIPTION OF EMBODIMENTS

A description will now be given below on an embodiment according to the present invention with reference to the drawings.

(Configuration of Wick 1)

First, a configuration of a wick 1 which is manufactured by a manufacturing method according to the present invention will be described.

Figure 1A:
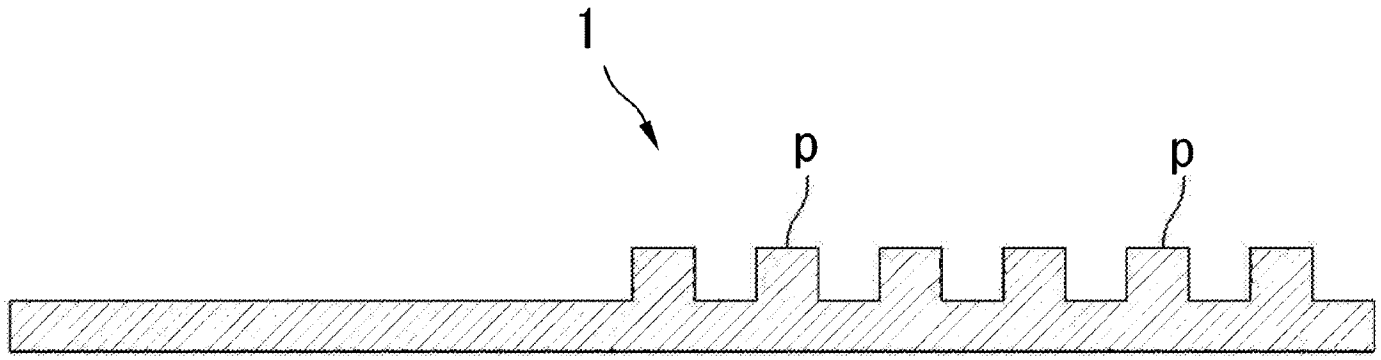
FIGS. 1(*a*) and 1(*b*) are cross-sectional views showing a configuration of a wick 1.
Figure 1B:
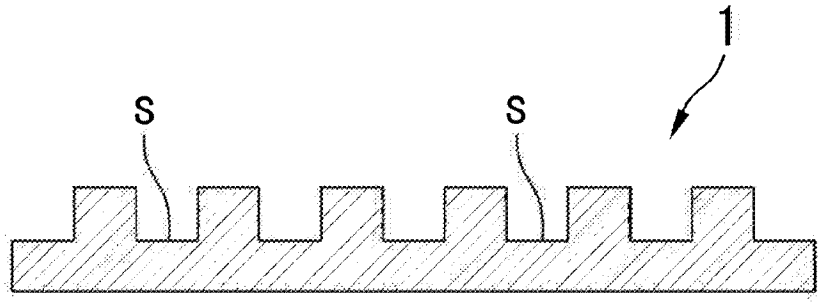

FIG. 1 are cross-sectional views showing the configuration of the wick 1. It is to be noted that FIG. 1(*a*) shows a cross section taken along a longitudinal direction of the wick 1, and FIG. 1(*b*) shows a cross section taken along a width direction of the wick 1.

As shown in FIG. 1, the wick 1 is formed into a sheet shape (a tabular shape). In this embodiment, the wick 1 is formed into a rectangular sheet shape. Furthermore, of both end portions of the wick 1 in the longitudinal direction, one end portion is arranged in a heating receiving section of a heat conduction member, and the other end portion is arranged in a heat radiating section of the heat conduction member. The heat conduction member will be described later.

Steam passages s through which a vaporized working fluid (steam) flows are provided on at least one surface of an upper surface and a lower surface of the wick 1. As shown in FIG. 1(*b*), in this embodiment, on the upper surface of the wick 1, the steam passages s are provided. Moreover, the steam passages s are grooves formed in a reticular pattern (a matrix pattern/line-column pattern). It is to be note that the wick 1 may be configured with no steam passages s provided thereon. When such a configuration is adopted, the steam passages are provided on a later-described container side.

Additionally, protrusions p configured to suppress boiling vibration are provided on at least one surface of the upper surface and the lower surface of the wick 1. As shown in FIG. 1(*a*), in this embodiment, on the upper surface of the wick 1, the plurality of protrusions p aligned in a reticular pattern (a matrix pattern/line-column pattern) are provided. That is, on the upper surface of the wick 1, a plurality of protrusion rows each formed of the plurality of protrusions p aligned along the longitudinal direction are formed along the width direction. Each protrusion p is formed into a prismatic shape which protrudes upward. Further, in this embodiment, a space between two protrusions adjacent to each other constitutes the steam passage s. As a result, in this embodiment, forming the steam passages s in the reticular pattern (the matrix pattern/line-column pattern) on the upper surface of the wick 1 enables forming the plurality of protrusions p aligned in the reticular pattern (the matrix pattern/line-column pattern) on the upper surface of the wick 1. It is to be noted that the wick 1 may be configured with no protrusions p provided thereto.

Here, shapes/configurations of the steam passages sand the protrusions p can be appropriately changed. That is, each steam passage s can take any shape/configuration as long as the vaporized (evaporated) working fluid can be caused to reach a portion arranged in the heat receiving section to a portion arranged in the heat radiating section in the wick 1. For example, on the upper surface of the wick 1, the steam passages s may be constituted by providing one or more grooves, which extend in the longitudinal direction, along the width direction. Alternatively, on the upper surface of the wick 1, each steam passage s may be constituted of a space between two protrusions adjacent to each other after irregularly arranging the plurality of protrusions. Furthermore, a shape of each protrusion p may be any other shape such as a columnar shape.

The wick 1 is made of a sintered compact and has a porous structure.

The wick 1 is made of Cu, Fe, Ni, Cr, Ti, Al, Ag, and Sn or an alloy of these materials. In particular, the wick 1 is preferably made of Cu or Al.

An average void ratio of the wick 1 (whole) preferably falls within the range of 5 to 90%. That is, when the average void ratio of the wick falls below 5%, there is a fear that voids do not become communicating holes. On the other hand, when the average void ratio of the wick 1 exceeds 90%, there is a risk that strength becomes insufficient. Thus, the average void ratio of the wick 1 preferably falls within the range of 5 to 90%, particularly the range of 10 to 70%.

A thickness of the wick 1 preferably falls within the range of 0.05 to 1.0 mm. That is, to reduce the thickness of the wick 1 to be less than 0.05 mm, material powder must be micronized, which increases a material cost. Moreover, when the thickness of the wick 1 falls below 0.05 mm, the strength becomes insufficient, and handling becomes difficult. Additionally, with a reduction in thickness of the heat conduction material in recent years, when the thickness of the wick 1 exceeds 1.0 mm, arrangement in the heat conduction material becomes difficult. Thus, the thickness of the wick 1 preferably falls within the range of 0.05 to 1.0 mm, particularly the range of 0.1 to 0.6 mm. Here, the thickness of the wick 1 refers to a dimension of a portion having a maximum thickness (a maximum dimension) in the wick 1.

(Method for Manufacturing Wick 1)

A description will now be given on a method for manufacturing the wick 1.

Figure 2B:
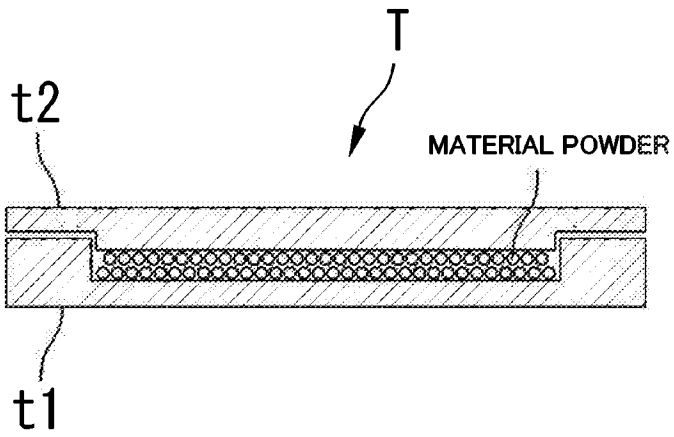
FIGS. 2(*a*) and 2(*b*) are cross-sectional views showing an example of a base.
Figure 2A:
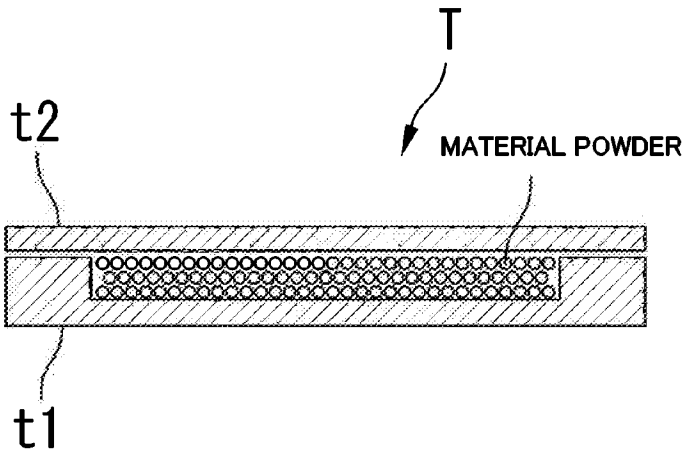

FIG. 2 are cross-sectional views showing an example of a base.

To manufacture the wick 1, material powder is first produced.

As the material powder, it is possible to use a combination of one or more metal powders (alloy powder) among Cu powder, Fe powder, Ni powder, Cr powder, Ti powder, Al powder, Ag powder, Sn powder, and the alloy powder.

As the alloy powder, it is possible to use alloy powder composed of one or more metals among Cu, Fe, Ni, Cr, Ti, Al, Ag, and Sn.

Further, a binder such as a thermoplastic resin or a wax may be added to the material powder.

Moreover, a binder such as a thermoplastic resin or wax may be added to the material powder.

Furthermore, in some cases, when a plurality of components are mixed to produce the material powder, segregation/size segregation is apt to occur. Thus, in this case, a liquid which is 0.5 ml/kg or less (e.g., an oil whose viscosity is 20 $mm^2/s$ or less) may be added to the material powder. As a result, the segregation/size segregation can be suppressed.

The material power is then supplied onto the base.

The base may take any shape as long as the material powder can be mounted thereon. However, the base must be made of a material having high heat resistance such as refractory metal, ceramics, or carbon. Additionally, a surface of the base onto which the material powder is supplied is preferably flat.

For example, as the base, a frame body (not shown), a tray T (see FIG. 2, FIG. 4, and FIG. 5), a metal belt 11*a* (see FIG. 3), or the like can be used.

As shown in FIG. 2, the tray T is configured to include a tray main body t1 and a lid body t2. The tray main body t1 is formed into a substantially rectangular box shape (a frame shape) whose upper surface is opened so that it can be filled with the material powder. The lid body t2 is formed into a substantially rectangular tabular shape so that the upper surface of the tray main body t1 can be closed. Since the tray T includes the lid body t2, the material powder filled in the tray main body t1 can be prevented from scattering.

Here, as shown in FIG. 2(*a*), when a bottom surface of the lid body t2 is formed flat, the material powder can be accommodated in the tray main body t1 in an uncompressed state. On the other hand, as shown in FIG. 2(*b*), when a convex portion, which is inserted into an upper end portion of the tray main body t1, is formed on the bottom surface of the lid body t2, the material powder can be accommodated in the tray main body t1 in a slightly compressed state.

Subsequently, the material powder which has been supplied onto the base is smoothened.

That is, a thickness (a height) of the material powder which has been supplied onto the base is uniformized.

At this moment, the material powder which has been supplied onto the base can be smoothened with the use of smoothening means such as a plate material or a roller.

For example, in case of using the tray T as the base, after filling the tray main body t1 with the material powder, leveling off the excess material powder with the upper end portion of the tray main body t1 determined as a reference by using the plate material enables smoothening the material powder. Then, to prevent the material powder from moving or scattering, the lid body t2 is put.

On the other hand, as will be described later, in case of using the metal belt 11*a* as the base, the material powder can be smoothened by using a roller 13. Alternatively, the metal belt 11*a* may be formed into a concave shape (a frame shape). When such a configuration is adopted, after filling the metal belt 11*a* with the material powder, leveling off the excess material powder with an upper limit portion of the metal belt 11*a* determined as a reference by using the plate material realizes smoothening the material powder.

Here, bulk density of the material powder before sintering is preferably set to fall within the range of 10 to 50% to true density (material density with no void), particularly the range of 15 to 35% to the true density. Furthermore, a thickness of the material powder before sintering preferably falls within the range of 0.1 to 2.0 mm, particularly the range of 0.15 to 1.5 mm.

Then, the material powder which has been supplied onto the base is sintered (heated).

That is, the material powder on the base is sintered in a predetermined sintering atmosphere/at a predetermined sintering temperature to form a sintered compact. When the material powder is sintered, metal particles adjacent to each other are subjected to the diffusion bonding, and the metal particles are coupled to form the porous sintered compact.

At this moment, as the sintering atmosphere, a vacuum, a neutral gas (a nitrogen gas, an argon gas, or the like), a reducing gas (an ammonia decomposition gas, a hydrogen gas, an endothermic gas, or the like), or the like is appropriately selected in correspondence with a composition of the material powder.

Moreover, the sintering temperature is appropriately selected in the range of 400 to 1050° C. in correspondence with the composition of the material powder.

For example, in case of using pure copper powder as the material powder, the ammonia decomposition gas is preferably selected as the sintering atmosphere, and a temperature in the range of 800 to 1050° C. is preferably selected as the sintering temperature.

The sintered compact taken out from the base is then rolled.

That is, the sintered compact is rolled by using a rolling apparatus.

Rolling the sintered compact enables reducing a thickness of the sintered compact, uniformizing the thickness of the sintered compact, improving surface roughness of the sintered compact, and increasing sintering density.

In particular, rolling the sintered compact enables controlling the thickness/density/void ratio of the sintered compact and controlling a thickness/density/void ratio/capillarity of the wick 1.

The rolling apparatus is configured to include a pair of rollers arranged at a predetermined interval. At the time of rolling, each roller is rotated. Additionally, the sintered compact passes between the pair of rollers, whereby it is rolled with a desired thickness and desired density.

Here, at the time of rolling the sintered compact, one rolling apparatus alone may be used to roll the sintered compact, or a plurality of rolling apparatuses may be used to roll the sintered compact in a step-by-step manner.

Further, at the time of rolling the sintered compact, the sintered compact may be rolled by the rolling apparatus while being heated at a predetermined heating temperature. At this moment, the heating temperature is appropriately selected in correspondence with the composition of the material powder.

Here, an average void ratio of the sintered compact (whole) after rolling preferably falls within the range of 5 to 90%, particularly the range of 10 to 70%. Furthermore, the thickness of the sintered compact after rolling preferably falls within the range of 0.05 to 1.0 mm, particularly the range of 0.1 to 0.6 mm. Here, the thickness of the sintered compact after rolling refers to a dimension of a portion having a maximum thickness (a maximum dimension) in the sintered compact.

Then, various kinds of processing are applied to the sintered compact after rolling.

For example, in the sintered compact, steam passages s, protrusions p, and the like are formed. They can be formed by press working, machining, etching processing, or the like.

Thus, the wick 1 is formed.

(Manufacturing Line of Wick 1)

A description will now be given on a first example of a manufacturing line (manufacturing facilities) of the wick 1.

Figure 3:
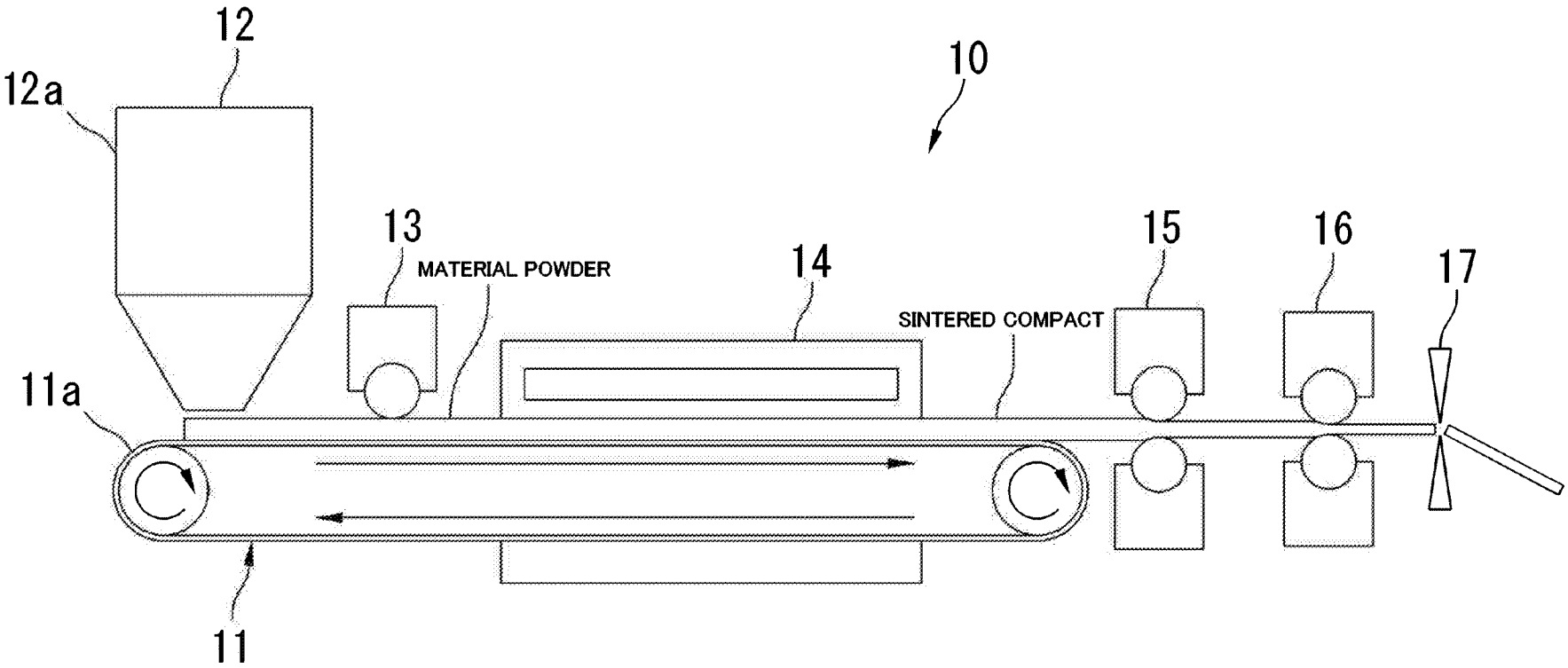
FIG. 3 is a view showing a first example of a manufacturing line of the wick 1.

FIG. 3 is a view showing the first example of the manufacturing line of the wick 1.

The wick 1 can be manufactured with the use of, e.g., the manufacturing line 10 shown in FIG. 3.

The manufacturing line 10 is configured to include a belt conveyer 11, a hopper 12, a roller 13, a sintering furnace 14, rolling apparatuses 15 and 16, and a cutting apparatus 17.

The belt conveyer 11 is configured to include a metal belt 11*a* which circulates by rotation of a truck. The metal belt 11*a* is made of a refractory metal.

The hopper 12 is configured to include a storage tank 12*a* which stores the material powder. Further, the hopper 12 supplies the material powder stored in the storage tank 12*a* onto an upper surface of the metal belt 11*a*. At this moment, the hopper 12 operates in such a manner that an amount of the material powder supplied per unit time becomes fixed.

The roller 13 is arranged above the metal belt 11*a* so that its rotation shaft extends along a direction orthogonal to a traveling direction of the metal belt 11*a*. In particular, the roller 13 is arranged in such a manner that an interval between the metal belt 11*a* and itself becomes a predetermined interval.

The sintering furnace 14 is formed into a box shape, and constituted in such a manner that the metal belt 11*a* passes through the inside thereof. In the sintering furnace 14, a heater is arranged so that the material powder arranged on the metal belt 11*a* can be heated in a predetermined atmosphere.

Each of the rolling apparatuses 15 and 16 is configured to include a pair of rollers. In the manufacturing line 10, the sintered compact is rolled by the two rolling apparatuses 15 and 16 in a step-by-step manner.

The cutting apparatus 17 is configured to include a pair of cutting blades. The pair of cutting blades are opened and closed at a predetermined cycle. Consequently, the sintered compact passes between the pair of cutting blades to be cut into a desired length.

In the manufacturing line 10, the material powder is first supplied onto the upper surface of the metal belt 11*a* by the hopper 12 (a filling apparatus).

The material powder supplied to the upper surface of the metal belt 11*a* is carried from the upstream side toward the downstream side by the circulation of the metal belt 11*a*.

That is, the material powder which has been supplied onto the upper surface of the metal belt 11*a* first passes underneath the roller 12. At this moment, the material powder supplied onto the upper surface of the metal belt 11*a* is smoothened by an outer peripheral surface of the roller 12, and a thickness (a height) of the material power is uniformized.

The material powder arranged on the upper surface of the metal belt 11*a* then passes through the inside of the sintering furnace 14. At this moment, the material powder supplied onto the upper surface of the metal belt 11*a* is heated by the heater, and a sintered compact is formed.

The sintered compact arranged on the upper surface of the metal belt 11*a* then passes through the respective rolling apparatuses 15 and 16. At this moment, the sintered compact is rolled by the respective rolling apparatuses 15 and 16.

The sintered compact arranged on the upper surface of the metal belt 11*a* then passes through the cutting apparatus 17. At this moment, the sintered compact is cut into a desired length by the pair of cutting blades.

Thereafter, processing to form steam passages s, protrusions p, and the like is performed to the sintered compact. It is to be noted that, the processing to form the steam passages s, the protrusions p, and the like may be performed to the sintered compact before passing through the cutting apparatus 17.

Thus, the wick 1 is manufactured.

A description will now be given on a second example of the manufacturing line (manufacturing facilities) of the wick 1.

Figure 4:
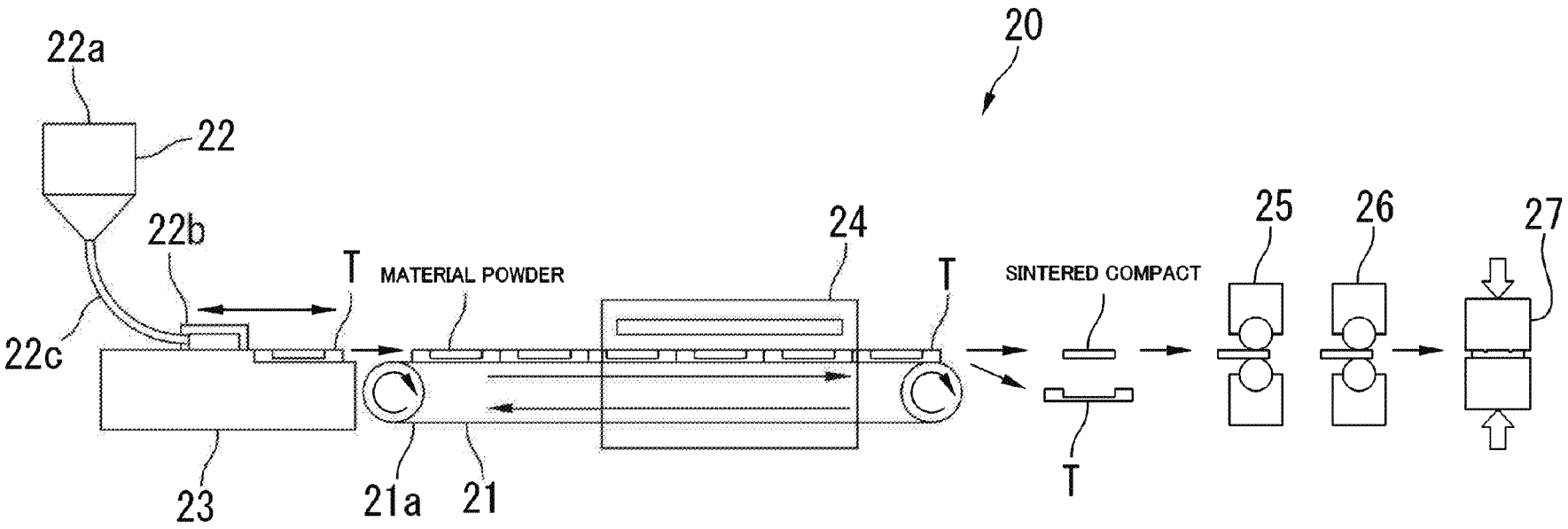
FIG. 4 is a view showing a second example of the manufacturing line of the wick 1.

FIG. 4 is a view showing the second example of the manufacturing line of the wick 1.

The wick 1 can be likewise manufactured with the use of a manufacturing line 20 shown in FIG. 4.

The manufacturing line 20 is configured to include a belt conveyer 21, a filling apparatus 22, a filling base 23, a sintering furnace 24, rolling apparatuses 25 and 26, and a press apparatus 27.

The filling base 23 is configured to include a tray installing section on which a tray T can be installed (mounted).

The filling apparatus 22 is configured to include a storage tank 22*a* which stores the material powder and a powder box 22*b* which reciprocate on an upper surface of the filling base 23.

The powder box 22*b* is formed in to a box shape so that the material powder can be accommodated therein. Furthermore, one or more opening portions (through holes) are provided in a bottom surface of the powder box 22*b*. In this embodiment, each opening portion is formed into a slit shape extending in a direction orthogonal to a traveling direction of the powder box 22*b*. Moreover, the plurality of opening portions which are parallel to each other are provided in the bottom surface of the powder box 22*b*. It is to be noted that the number/shape/size of the opening portions can be appropriately set.

In the filling apparatus 22, the material powder stored in the storage tank 22*a* is supplied into the powder box 22*b* through a hose 22*c*. Additionally, the powder box 22*b* is reciprocated on an upper surface of the filling base 23 along a predetermined direction by a non-illustrated driving mechanism. At this moment, when the powder box 22*b* passes above the tray T installed on the tray installing section, the material powder accommodated in the powder box 22*b* is caused to fill the tray T by its own weight through the opening portions.

The belt conveyer 21 is configured to include a metal belt 21*a* which circulates by rotation of a track. Further, the belt conveyer 21 can carry the tray T arranged on the metal belt 21*a* by the circulation of the metal belt 21*a*.

The sintering furnace 24 is formed into a box shape, and configured in such a manner that the tray T installed on the metal belt 21*a* can pass through the inside thereof. In the sintering furnace 24, a heater is arranged, and the material powder filling the tray T can be heated in a predetermined atmosphere.

Each of the rolling apparatuses 25 and 26 is configured to include a pair of rollers. Each of the rolling apparatuses 25 and 26 can roll the sintered compact by the pair of rollers.

The press apparatus 27 is configured to include a pair of press molds. Furthermore, the press apparatus 27 can form steam passages s, protrusions p, and the like on the sintered compact by opening/closing (compression) of the pair of press molds.

In the manufacturing line 20, the empty tray T is first installed on the tray installing section of the filling base 23.

Then, the tray T installed on the tray installing section is filled with the material powder by the filling apparatus 22. That is, on the upper surface of the filling base 23, the powder box 22*b* is reciprocated. Consequently, the tray T installed on the tray installing section is filled with the material powder in the powder box 22*b*.

Then, a plate material is used to level off the excess material powder with an upper end portion of a tray main body t1 determined as a reference, and then a lid body t2 is put. Here, the excess material powder may be leveled off by the reciprocation of the powder box 22*b* with the upper end portion of the tray main body t1 determined as a reference.

Subsequently, the tray T is installed on the upper surface of the metal belt 21*a*. Consequently, the tray T is carried from the upstream side toward the downstream side by the circulation of the metal belt 21*a*.

The tray T carried by the metal belt 21*a* passes through the inside of the sintering furnace 24. At this moment, the material powder filling the tray T is heated by a heater 24, thereby forming a sintered compact.

Then, the sintered compact is taken out from the tray T, and the taken-out sintered compact is rolled by the respective rolling apparatuses 25 and 26 in a step-by-step manner. Consequently, the sintered compact can have a desired thickness/average void ratio.

Subsequently, the rolled sintered compact is compressed by the press apparatus 27. Consequently, steam passages s, protrusions p, and the like are formed on the sintered compact.

Thus, the wick 1 is manufactured.

A description will now be given on a third example of the manufacturing line (the manufacturing facilities) of the wick 1.

Figure 5:
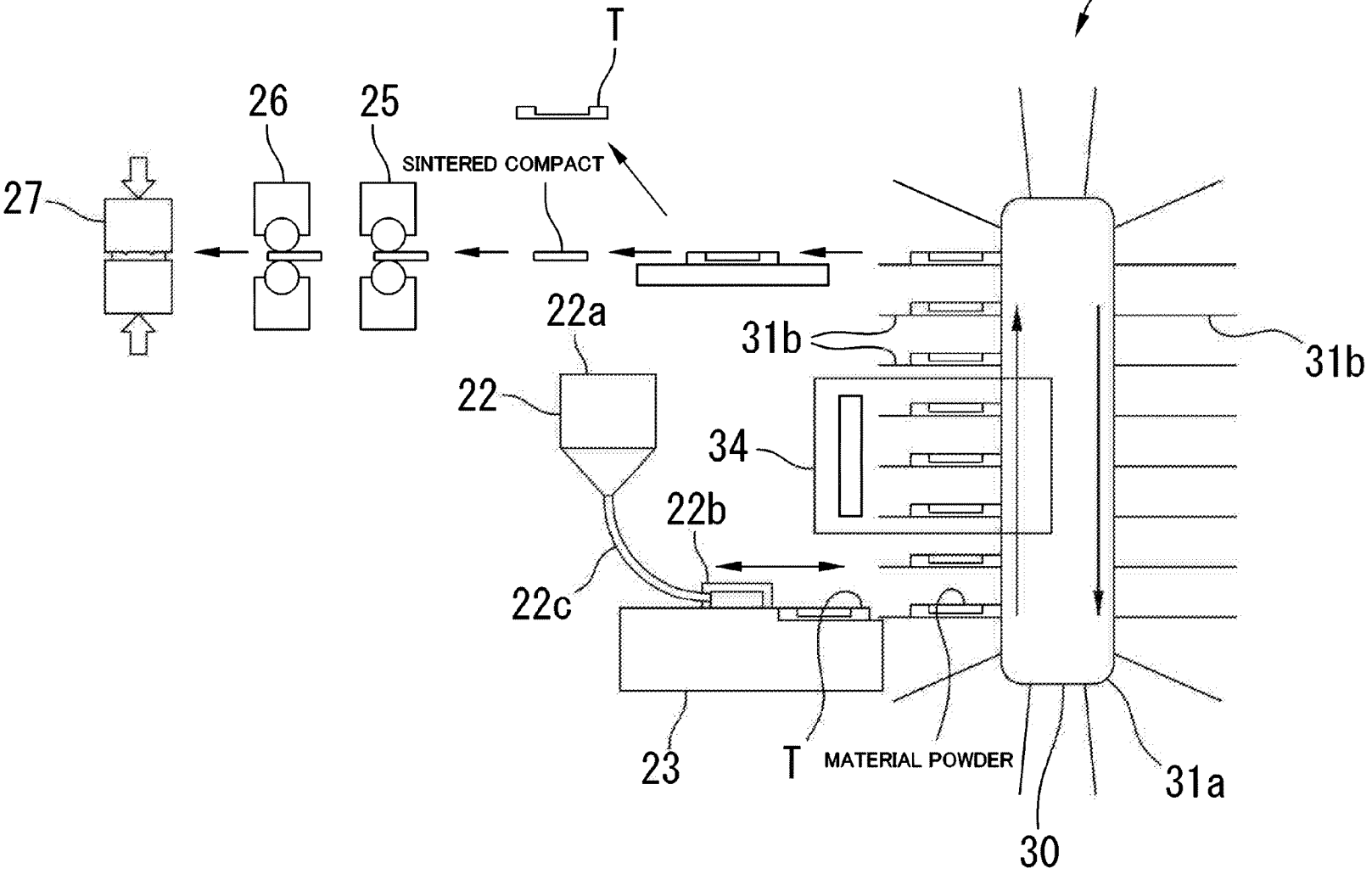
FIG. 5 is a view showing a third example of the manufacturing line of the wick 1.

FIG. 5 is a view showing the third example of the manufacturing line of the wick 1.

The wick 1 can be likewise manufactured by the manufacturing line 30 shown in FIG. 5.

A basic configuration of the manufacturing line 30 is the same as the manufacturing line. Thus, in the configuration of the manufacturing line 30, the same structures as those in the manufacturing line 20 are denoted by the same reference signs to omit a description thereof.

The manufacturing line 30 is different from the manufacturing line 20 in that a vertical sintering furnace 34 is arranged in place of the horizontal sintering furnace 24. In this connection, a carrier apparatus 31 is arranged in place of the belt conveyer 21 in the manufacturing line 30.

The carrier apparatus 31 is configured to include circulating means 31*a*, and a plurality of tray mounting sections 31*b* which are circulated by rotation of the circulating means 31*a*. Further, the carrier apparatus 31 can carry trays T mounted on the respective tray mounting sections 31*b* upward (toward a vertical direction).

The sintering furnace 34 is formed into a box shape so that the trays T mounted on the respective mounting sections 31*b* can pass through the inside thereof. In the sintering furnace 34, a heater is arranged so that material powder filling the trays T can be heated in a predetermined atmosphere.

In the manufacturing line 30, the empty trays T are first installed on the tray installing sections of a filling base 23.

Then, the trays T installed on the tray installing sections are filled with the material powder by a filling apparatus 22.

Subsequently, a plate material is used to level off the excess material powder with an upper end portion of each tray main body t1 determined as a reference, and a lid body t2 is put.

Then, the trays T are installed on upper surfaces of the tray mounting sections 31*a*. Consequently, the trays T are carried upward by rotation (circulation) of the circulating means 31*a*.

The trays T carried upward pass through the inside of the sintering furnace 24. At this moment, the material powder filling the trays T is heated by the heater 34, thereby forming sintered compacts.

Then, the sintered compacts are taken out from the trays T, and the taken-out sintered compacts are rolled by respective rolling apparatuses 25 and 26 by a step-by-step manner. Consequently, the sintered compacts can have a desired thickness/average void ratio.

Subsequently, the rolled sintered compacts are compressed by a press apparatus 27. Consequently, steam passages s, protrusions p, and the like are formed on the sintered compacts.

Thus, the wick 1 is manufactured.

In the manufacturing line 30, the vertical sintering furnace 34 is applied, and the trays T are carried along the vertical direction by the carrier apparatus 31 (according to an elevator system). Consequently, as compared with the manufacturing line 20, space saving of the facilities can be achieved.

Here, apparent density of the material powder before sintering changes in correspondence with a state of the material powder such as a composition (a lot) of the material powder or a working environment where the material powder is handled. Thus, when manufacturing the wick 1, natural filling density of the material powder before sintering must be adjusted (changed) in correspondence with a state of the material powder.

At this moment, changing configurations of sintering jigs, e.g., changing a thickness of the frame body or changing a depth of the tray T enables adjusting the natural filling density of the material powder before sintering. However, preparing the sintering jigs having different configurations in accordance with a state of the material powder is not realistic.

Thus, in the manufacturing line 10, a mechanism which adjusts (changes) a powder height (a storage amount) of the material powder stored in the storage tank 12*a* of the hopper 12 may be provided. When such a configuration is adopted, adjusting a weight of the material powder itself stored in the storage tank 12*a* enables adjusting bulk density (filling bulk density) of the material powder which is supplied (filled) onto the base (the metal belt 11*a*).

Alternatively, in the manufacturing lines 20 and 30, a mechanism which adjusts (changes) a powder height (a storage height) of the material powder accommodated (stored) in the powder box 22*b* of the filling apparatus 22 may be provided. When such a configuration is adopted, adjusting a weight of the material powder itself accommodated in the powder box 22*b* enables adjusting the bulk density (the filling bulk density) of the material powder supplied (filled) onto the base (the tray T).

(Configuration of Heat Conduction Member)

The wick 1 can be applied (used) to a heat conduction member (a heat radiation member) such as a heat pipe or a vapor chamber.

The heat conduction member (not shown) is configured to include a container, a working fluid, and the wick 1.

The container is configured to seal (hermetically contain) the working fluid and the wick 1 therein. As a shape of the container, a cylindrical shape, a flat shape, or the like is appropriately selected in correspondence with an intended use. The container is made of a material with a high heat conductivity such as Cu or Al.

The container according to this embodiment is a rectangular sheet-shaped case made of native copper. Furthermore, in the container, one end portion of both end portions along the longitudinal direction is determined as a heat receiving section, and the other end portion is determined as a heat radiating section.

As the working fluid, it is possible to use water (H2O), helium (He), nitrogen (N2), Freon 22 (CHCIF2), HFC-134a (CH2F—CF3), ammonia (NH3), Freon 113 (CCI2F—CCIF2), HCFC-123 (1, 1-dichloro-2, 2, 2-trifluoroethane), acetone (C3H6O), methanol (CH4O), dowtherm A ((C6H5)2+(C6H5)2O), naphthalene (C10H8), cesium (Cs), natrium (Na), lithium (Li), silver (Ag), or the like.

In the heat conduction member according to this embodiment, the container is formed by bonding a plate material made of native copper, a sheet material, or the like in a bag-like shape by sputtering, welding, or the like.

Furthermore, the wick 1 and the working fluid are sealed in the container. The wick 1 and the working fluid are sealed in the container in a state where the inside of the container is vacuum-deaired. Consequently, the inside of the wick having the porous structure is impregnated with the working fluid.

In the heat conduction member, the wick 1 is arranged along the container. That is, in the container, one end portion of both the end portions in the longitudinal direction of the wick 1 is arranged in the heat receiving section, and the other end portion is arranged in the heat radiating section.

The heat receiving section of the heat conduction member is arranged in a state where it adheres to a heating body such as a CPU through heat conductive grease. Consequently, heat of the heating body is conducted to the heat receiving section.

In the heat conduction member, the working fluid is heated by the heat conducted to the heat receiving section, and the heated working fluid is vaporized (evaporated). Moreover, the working fluid vaporized by the heat receiving section passes through the steam passages s and flows into the heat radiating section. Here, the heat radiating section has a relatively low temperature with respect to the heat receiving section. Consequently, the working fluid which has flowed into the heat radiating section is cooled by the heat radiating section, and the cooled working fluid is liquefied (condensed). At this moment, the heat conducted from the heating body is discharged as latent heat. Additionally, the working fluid liquefied in the heat radiating section is absorbed into the wick 1 by the capillarity of the wick 1, passes through the inside of the wick, and is refluxed from the heat radiating section to the heat receiving section. Thus, repeating the circulation of the working fluid enables continuing movement of the heat from the heat receiving section to the heat radiating section, thereby continuously discharging the heat of the heating body.

Here, the heat conduction member can be applied to cooling of various kinds of electronic devices (a personal computer, a mobile terminal, and the like), cooling of a nickel-metal-hydride battery or a lithium battery used in a car, or the like.

(Functions/Effects of Method for Manufacturing Wick 1)

According to the method for manufacturing the wick 1, the sintered compact is formed by heating the material powder supplied onto the base. Consequently, the sheet-shaped sintered compact can be formed.

Further, according to the method for manufacturing the wick 1, the sintered compact is rolled. Consequently, after forming the sintered compact, a void ratio of the sintered compact can be controlled, thereby controlling the capillarity of the wick 1. In particular, after forming the sintered compact, a thickness of the sheet-shaped sintered compact can be controlled, thereby reducing a thickness of the wick 1.

Furthermore, according to the method for manufacturing the wick 1, the material powder supplied onto the base is smoothened. Consequently, in the rolled sintered compact, the density can be prevented from becoming nonuniform, thus avoiding the nonuniform capillarity of the wick 1.

Moreover, according to the method for manufacturing the wick 1, the steam passages s, the protrusions p, and the like are formed on the surface of the rolled sintered compact. Consequently, in the sintered compact having the porous structure, since the steam passages s, the protrusions p, and the like are formed, the steam passages s, the protrusions p, and the like can be easily formed as compared with a case where the steam passages are formed on the container side.

Additionally, according to the method for manufacturing the wick 1, the container of the heat conduction member and the wick 1 can be individually formed. Consequently, it is not necessary to take a method for forming the wick in the container by externally heating the container after filling the container with the metal powder, and deterioration of the container due to heating can be avoided.

REFERENCE SIGNS LIST

1 wick
11*a* metal belt
s steam passage
P protrusion
T tray

The invention claimed is:

1. A method for manufacturing a wick, the method comprising:

supplying a raw material containing metal powder onto a base;

heating the raw material on the base to obtain a sintered compact; and rolling the sintered compact, wherein the method further comprises adding a liquid which is 0.5 ml/kg or less to the material powder before the supplying of the raw material onto the base.

2. The method according to claim 1, wherein the raw material contains a binder.

3. The method according to claim 1, wherein the raw material on the base is heated together with the base.

4. The method according to claim 1, wherein the base is made of a metal.

5. The method according to claim 1, further comprising smoothening the raw material powder on the base.

6. The method according to claim 1, further comprising forming steam passages on a surface of the sintered compact after the rolling of the sintered compact.

7. The method according to claim 1, further comprising forming protrusions, which are configured to suppress boiling vibration, on a surface of the sintered compact after the rolling of the sintered compact.

8. The method according to claim 1, further comprising cutting the sintered compact.

9. The method according to claim 1, wherein an average void ratio of the wick falls within a range of 5% to 90%.

10. The method according to claim 1, wherein a thickness of the wick falls within a range of 0.05 mm to 1.0 mm.

11. The method according to claim 1, wherein a bulk density of the material powder before the heating of the raw material falls within a range of 10% to 50% to true density.

12. The method according to claim 1, wherein a thickness of the material powder before the heating of the raw material falls within a range of 0.1 mm to 2.0 mm.

13. The method according to claim 1, wherein a sintering temperature is in a range of 400° C. to 1050° C.

* * * * *